United States Patent [19]

Cooper et al.

[11] Patent Number: 4,732,627

[45] Date of Patent: Mar. 22, 1988

[54] METHOD FOR IMPROVING THE QUALITY OF AN EMULSION EXPLOSIVE COMPOSITION

[75] Inventors: John Cooper; Ian J. Kirby, both of Alloway, Scotland

[73] Assignee: Imperial Chemical Industries PLC, London, England

[21] Appl. No.: 906,735

[22] Filed: Sep. 9, 1986

[30] Foreign Application Priority Data

Sep. 19, 1985 [GB] United Kingdom ..... 8523127
Jan. 21, 1986 [GB] United Kingdom ..... 8601370

[51] Int. Cl.[4] ..... D03D 23/00
[52] U.S. Cl. ..... 149/109.6; 149/2; 324/450
[58] Field of Search ..... 324/450; 149/2, 109.6

[56] References Cited

U.S. PATENT DOCUMENTS 4,016,018 4/1977 Lenotre ..... 149/19.1
4,496,405 1/1985 Cechanski ..... 149/2
4,496,906 1/1985 Clack ..... 324/450

*Primary Examiner*—Stephen J. Lechert, Jr.
*Attorney, Agent, or Firm*—Cushman, Darby & Cushman

[57] ABSTRACT

A method and apparatus for improving the quality of an emulsion explosive composition by selecting an electrical characteristic of the composition, establishing a predetermined range of values therefor, measuring the selected characteristic of the composition and, in response to a measured characteristic outwith the predetermined range, diverting, or treating the composition to restore the selected characteristic to within the predetermined range.

Suitable characteristics include conductivity and capacitance, and the technique may be employed in a static location or on a mobile carrier.

9 Claims, 5 Drawing Figures

METHOD FOR IMPROVING THE QUALITY OF AN EMULSION EXPLOSIVE COMPOSITION

BACKGROUND OF THE INVENTION (a) Technical Field of Invention

This invention relates to a method and apparatus for improving the quality of an emulsion explosive composition.

(b) Background of the Art

Commercially available emulsion explosive compositions generally comprise an external or continuous organic fuel phase in which discrete droplets of an aqueous solution of an oxygen-supplying source are dispersed as an internal or discontinuous phase. Such compositions are conventionally described as water-in-oil emulsion explosive compositions, and examples thereof have been described, inter alia, in U.S. Pat. Nos. 3,447,978, 3,674,578, 3,770,522, 4,104,092, 4,111,727, 4,149,916 and 4,149,917.

For certain applications the water content of the oxidiser phase of the emulsion explosive may be completely eliminated or at least reduced to a low level—for example, to less than 4% by weight of the total emulsion composition. Such compositions are conventionally referred to as melt-in-oil or melt-in-fuel emulsion explosives and have been described, inter alia, in U.S. Pat. No. 4,248,644.

The term "emulsion explosive composition" is hereinafter employed to embrace compositions of both the water-in-oil (fuel) and melt-in-oil (fuel) types.

An emulsion explosive composition generally comprises a dispersion of droplets of the oxidiser phase in the continuous phase. These droplets are inherently metastable and exhibit a tendency to crystallise. Growth of the resultant crystals tends to impair the sensitivity to detonation of the emulsion explosive composition. In addition, if the droplets are too large the resultant composition may exhibit poor storage stability and/or poor blasting performance. Such behaviour may also result from the adventitious introduction of extraneous contaminants during production of the explosive composition. Desirably, therefore, the composition should be tested, before use, to assess it potential performance.

Hitherto, such test monitoring as could be performed has been on the basis of periodically extracting samples from the product stream for assessment by microscopic examination to determine droplet size, or by actual test detonation of the samples. At best, such monitoring is intermittent, involves skilled personnel, and entails delay in providing the required assessment. There is therefore a need for a method of assessment which provides a robust, rapid, even instantaneous, simple, and reliable evaluation of potential performance.

We have now devised such a method.

SUMMARY OF THE INVENTION

Accordingly, the present invention provides a method of improving the quality of an emulsion explosive composition comprising a discontinuous phase containing an oxygen-supplying component and an organic medium forming a continuous phase, by selecting an electrical characteristic of the explosive composition, establishing a predetermined range of acceptable values for that characteristic, measuring the selected electrical characteristic of the explosive composition, and, in response to a measured electrical characteristic outwith the predetermined range, diverting the unacceptable composition or treating the composition to restore the selected electrical characteristic thereof to within the predetermined acceptable range.

DETAILED DESCRIPTION AND PREFERRED EMBODIMENTS OF THE INVENTION

Figure 1:
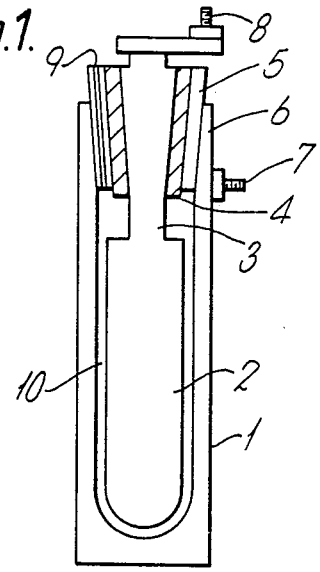

A suitable electrical characteristic of an emulsion explosive composition to be measured in accordance with the invention is any measurable electrical characteristic which is capable of being related, directly or indirectly, to the storage stability, blasting performance, sensitivity to detonation, or any other desired behaviour parameter of the composition. Suitable electrical characteristics include Permittivity (Absolute or Relative), Resistivity, Conductivity (i.e. the reciprocal of Resistivity) and Capacitance. For convenience and ease of measurement it is preferred to measure Conductivity (i.e. the ratio of current density to applied electric field), and/or Capacitance (i.e. the ratio of total electric charge to potential).

Electrical conductivity measurements have been found to provide a useful indication of the sensitivity of detonation and to the storage stability characteristics of an emulsion explosive composition, while electrical capacitance measurements have been found to provide a reliable indication of emulsion droplet size, and hence of blasting performance and stability. Thus, although in accordance with the invention at least one electrical characteristic of the emulsion explosive composition should be measured, it may be desirable to measure two, or more, of such characteristics to provide a more comprehensive assessment of potential behaviour and performance.

In respect of the electrical characteristic selected for measurement, it is necessary to define a predetermined range of values within which acceptable performance of the emulsion explosive composition will be achieved. For example, as hereinafter described, the electrical conductivity of various emulsion explosive formulations may be measured under specified conditions, samples of each formulation thereafter being stored under standard conditions and periodically subjected to detonation by a standard charge, thereby to establish the maximum storage period for which each formulation remains reliably detonatable. Likewise, measured electrical capacitance values may be correlated with the droplet sizes of emulsion explosive compositions, as determined by optical microscopic examination, or with observed blasting performance of a selected composition evaluated in test boreholes. Effectively, therefore, the equipment employed to measure the selected electrical characteristic may be calibrated to correlate measured values with storage stability, explosive performance, or the like. An experienced operator is therefore readily able to define an appropriate range of values for a particular electrical characteristic in the knowledge that an emulsion explosive composition having a measured value of that characteristic within the defined range will reliably exhibit a certain storage stability, blasting performance, or the like.

To ensure reproducibility, it is desirable that repetitive measurements of the selected electrical characteristic are effected at the same electrical frequency. Such measurements are conveniently effected at an electrical frequency not exceeding 10 megahertz (MHz). However, to avoid fluctuations associated with electrical relaxation phenomena, it is preferred to effect measurements of electrical capacitance at electrical frequencies of not less than 1 kilohertz (kHz)—below which relaxation peaks are normally observed and which below 50 Hz may lead to unreliable measurements. Electrical capacitance measurements are therefore preferably effected above 50 Hz and more preferably in a range from 200 Hz to 10 MHz, particularly preferably from 1 kHz to 10 kHz. In contrast, electrical conductivity is particularly susceptible to variations in electrical frequency, and is therefore preferably measured at electrical frequencies not exceeding 2.0 hertz (Hz), and particularly below 0.1 Hz. Indeed, electrical conductivity is desirably measured at zero electrical frequency (i.e. Direct Current measurement).

The measurement of electrical characteristics of an emulsion explosive composition is also influenced by temperature, and it is therefore desirable that repetitive measurements in a particular sequence are effected at the same temperature. Any suitable temperature may be employed, but for convenience the measurement temperature will not exceed about 150° C. Measurement of electrical capacitance is desirably effected at the processing temperature employed in manufacturing the explosive composition, for example from about 20° to about 100° C., preferably at about 50° C., while electrical conductivity is conveniently measured at the highest temperature likely to be encountered during storage of the explosive composition. Thus, conductivity will generally be measured at temperatures up to about 100° C., preferably from ambient to 60° C.

Emulsion explosive compositions conventionally contain at least one adjuvant to improve or modify explosive performance. Such adjuvants include waxes to modify rheology characteristics, voiding agents, such as gas bubbles, porous particles or microballoons, to reduce density, and solid particulate materials, such as carbon or aluminium, to act as supplementary fuel components. Such materials influence electrical characteristics to varying degrees and are likely to mask the fundamental electrical characteristics of the emulsion per se. Measurement of electrical characteristics in accordance with the invention is therefore effected on emulsion compositions devoid of adjuvants of any kind which will influence the electrical characteristics thereof.

Apparatus for effecting measurement of an electrical characteristic in accordance with the invention conveniently comprises an assembly provided with a pair of electrodes, electrically insulated, and substantially uniformly spaced-apart, from each other to define a chamber within which a sample of an emulsion explosive composition may be located, and means for electrically connecting the respective electrodes to an appropriate electrical metering unit.

Desirably, the electrode assembly is provided with thermal control means, such as an associated conduit through which a thermal transfer fluid may be circulated, to maintain the assembly at a desired temperature. An associated thermocouple probe is of utility in providing a record of the measurement temperature.

When the assembly is to be employed in a batch sampling technique at least one insulating spacer may be provided between the electrodes, whereby the chamber is effectively a closed cell of constant dimensions, to aid reproducibility of the measurements. Spacers are suitably of an inert polymeric material, such as polymethylmethacrylate. ICI's PERSPEX (Trade Mark) brand of polymethylmethacrylate is particularly suitable for this application.

A suitable cell assembly for batch measurements comprises a pair of 304 stainless steel planar electrodes arranged in parallel and maintained at a separation of 3 mm by peripheral spacers of polymethylmethacrylate. Each electrode has an operative surface area of 10 $cm^2$, and attached to the rear surface of each plate is a sinusoidal conduit through which a thermal medium (eg hot water) may be circulated to maintain the cell at the desired temperature, e.g. 60° C., as indicated by a suitable thermocouple probe located in a port in one of the electrode plates.

To measure conductivity a sample of an emulsion explosive composition at a temperature above the crystallisation point thereof, is placed between the plates which are squeezed together to expel excess emulsion, the peripheral spacers ensuring that a constant volume is employed in successive evaluations. Thermal fluid is then circulated through the conduit until the desired temperature is recorded by the thermocouple, and the electrical conductivity of the sample in the cell is measured using a suitable meter—for example, a Fluke conductivity meter, Type 8050A.

In an alternative embodiment of the invention the apparatus comprises a pair of concentric cylindrical electrodes, electrically isolated from each other, and arranged to define an annular chamber, to receive a sample of emulsion explosive, and means for electrically connecting each electrode to an electrical metering unit. Thermal control means and/or insulating spacers may again be employed, if desired. A typical assembly of this kind comprises an innermost cylindrical electrode of nickel-plated Invar steel of 2 cm external diameter and length 10 cm concentrically located within a similar cylinder of 2.2 cm internal diameter and length 10 cm, the space between the cylinders constituting an annular chamber to receive an emulsion composition. In the absence of annular, polymeric electrode-separating spacers an apparatus generally of this kind conveniently constitutes a continuous flow conduit or cell comprising an inlet orifice to receive a supply of an emulsion explosive composition for measurement and an outlet orifice for discharge of composition on which the desired measurement has been effected. Such an assembly is particularly suitable for continuous on-line quality control measurements in a unit comprising supply means for delivering an emulsion explosives composition to the inlet orifice of the cell, means for monitoring an electrical characteristic of the composition within the cell, and means for discharging the composition from the outlet orifice of the cell.

The electrical metering unit may comprise a relatively simple and robust meter, such as an AVO meter, to provide a measure of resistivity, and hence of conductivity. More accurate measurements of conductivity may be achieved by precision meters—such as a Fluke conductivity meter, Type 8050A, or a Data Precision 3500 digital meter. Capacitance is conveniently measured by a digital meter—such as a Metertech digital capacitance meter, Model MT301.

The invention provides a reliable and robust technique for assessing explosive quality, and may be employed for batch sampling or continuous assessment, the periodicity of measurement being selected to suit operational requirements. Thus, batch sampling may be effected on a daily or hourly basis, or at other appropriate intervals. More frequent measurement is possible, particularly when a continuous flow assembly is employed.

The technique of the invention may be employed in a static location—for example, on an explosives production line in a factory, or on, in association with, a mobile carrier—for example, a vehicle (e.g. truck) provided with mixing means, such as a drum mixer or a static mixer assembly, whereby an explosive composition may be prepared in situ and subjected to quality assurance measurement immediately prior to introduction into on-site boreholes.

When an electrical characteristic measured in accordance with the invention falls outside the predetermined range, the resultant unacceptable explosive composition may be diverted or subjected to a further treatment. Diversion may comprise total rejection of the composition, recycle of the composition for further treatment, use of the composition for a less critical application than that initially envisaged, or examination of the composition by physical or chemical techniques to establish the cause of the deficiency. Further treatment may comprise a purification of the emulsion components—for example, to remove contaminants, such as anti-setting coatings which may have been applied to the oxidiser salt, or a modification of the reaction conditions employed in manufacture of the emulsion—for example, by adjusting the flow rates of at least one of the respective phase components to the emulsification chamber, adjusting pumping pressure to a static mixer (if employed) to control the amount of work done in producing a refined emulsion, by changing the additive(s), (e.g. surfactant(s)), adjusting the additive concentration, or adjusting the speed, time or temperature of mixing etc.

Measured values of an electrical characteristic may be recorded and/or displayed on a suitable gauge or a visual display unit (VDU) for inspection by an operator to assess and, if necessary, initiate appropriate corrective action. Alternatively, a signal proportional to the measured value may be derived, and the derived signal utilized to adjust or control reaction conditions via an appropriate feed-back loop and control assembly.

A predetermined range of acceptable values of a selected electrical characteristic is readily established by observation and experience, and, inter alia, depends on the envisaged use of a particular explosive composition. By way of illustration only, an acceptable storage life is generally achieved in respect of an emulsion explosive composition exhibiting an electrical conductivity, measured at a temperature of 60° C., of less than 60,000 picomhos/meter, but preferably less than 20,000 and, particularly preferably less than 2000 picomhos/meter. Measured electrical conductivity decreases with decreasing temperature, and conductivity values, measured at 25° C., of less than about 15,000 picomhos/meter, are indicative of acceptable storage stability. Similarly, and by way of illustration only, an electrical capacitance (measured at a temperature of 50° C. in a cell of empty capacitance of 30 pF) of about 32,000 picofarads (pF) is indicative of an emulsion explosive composition having a droplet size of about 3.0 microns. Capacitance measurements of about 22,500 and 18,000 pF correspond respectively to emulsion droplet sizes of about 2.0 and 1.5 microns, smaller droplet sizes being indicative of increased sensitivity to initiation by a standard detonator.

Figure 2:
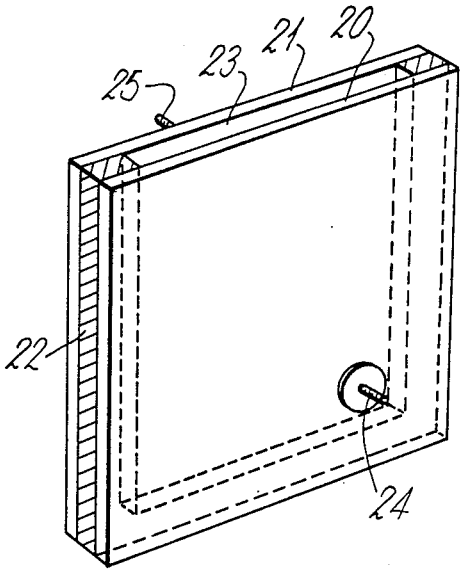
Figure 3:
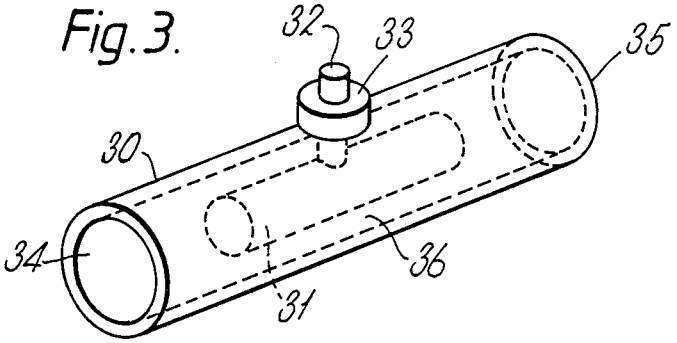
Figure 4:
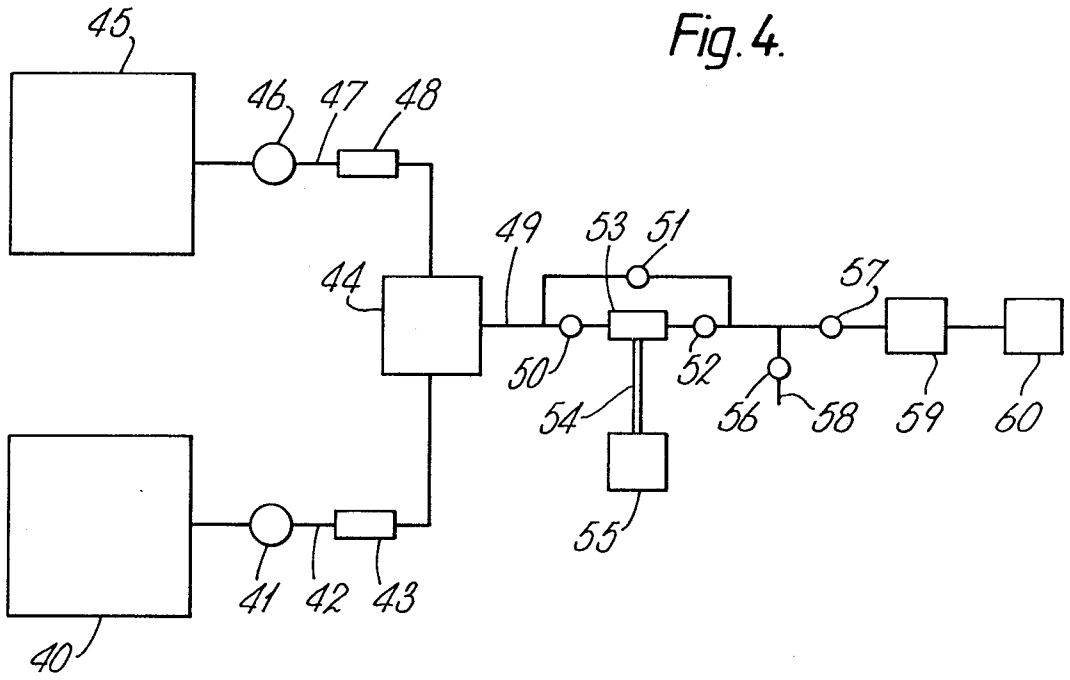
Figure 5:
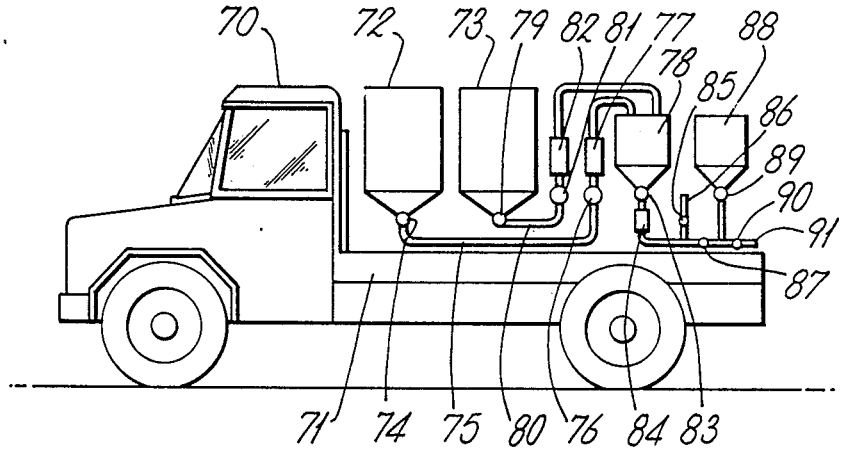

The invention is illustrated by reference to the accompanying schematic drawings in which FIG. 1 is a sectional elevation of a cylindrical electrode cell, FIG. 2 is a perspective view of a planar electrode cell, FIG. 3 is a perspective view of a continuous-flow, cylindrical electrode cell, FIG. 4 is a block diagram representing an emulsion explosives production and cartridging line, and FIG. 5 depicts a mobile carrier assembly for the production and delivery of an emulsion explosives composition.

A cell for the measurement of electrical conductivity of an emulsion explosives composition, as illustrated in FIG. 1, comprises a blind cylindrical outer electrode 1, of nickel-plated Invar steel, dimensioned to receive a solid, internal electrode 2 of the same material. Inner electrode 2 is suspended from an integral support 3 located by an electrically insulating quartz spacer 4 in a tapered steel sleeve 5 for insertion into the matching tapered mouth 6 in the outer electrode. Terminal posts 7, 8 associated respectively with the outer and inner electrodes are provided for connecting the cell assembly to an appropriate electrical conductivity meter (not shown).

In use, a portion of an emulsion explosives composition is introduced into the empty electrode 1, inner electrode 2 is then inserted and pressed home to ensure an adequate seal between sleeve 5 and mouth 6, surplus composition being displaced through a vent 9 in sleeve 5 to ensure that the annular chamber 10, having a radial width of about 1 mm, between the two electrodes is completely filled by the explosives composition. The assembly is then brought to a steady-state temperature, for example—by immersion in a thermostatically controlled liquid bath, and terminal posts 7, 8 are connected to a suitable meter, and independent power source (if required), whereby the electrical conductivity of the composition is measured.

The cell assembly of FIG. 2 comprises two planar electrode plates 20, 21, suitably of stainless steel, separated by an electrically-insulating peripheral spacer 22 to define a chamber 23, suitably of dimensions $100 \times 100 \times 3$ mm. Terminal posts 24, 25 respectively associated with electrodes 20 and 21 are provided for connecting the assembly to an appropriate monitoring assembly (not shown).

In use, a portion of an emulsion explosives composition is placed between the electrodes which are then squeezed together against spacer 22 to expel surplus composition through a gap in the spacer. The temperature of the cell is adjusted to the desired value, for example—by circulation of a thermal fluid, such as hot water or oil, though a conduit (not shown) attached to the outer surface of each electrode, and the desired electrical characteristic of the composition measured by an appropriate meter connected to terminal posts 24, 25.

The cell assembly of FIG. 3 comprises a cylindrical steel outer electrode 30, and a solid cylindrical steel inner electrode 31 suspended by an integral support 32 located within an electrically insulating sleeve 33 in the wall of the outer electrode. An emulsion explosives composition is fed to inlet orifice 34 and discharged from outlet orifice 35, the zone between the two cylindrical electrodes defining an annular chamber 36 in which the electrical characteristics of the composition flowing therethrough may be monitored, as already described, by an appropriate meter assembly (not shown).

In the system of FIG. 4, an oxidiser salt solution is fed from supply tank 40 by a pump 41 along conduit 42 and through a flow meter 43 to an emulsification chamber 44 to which an oil/surfactant blend is simultaneously fed from supply tank 45 by a pump 46 along conduit 47 and through a flow meter 48. The flow of the resultant emulsion explosives composition from chamber 44 along transfer conduit 49 is controlled by a series of valves 50, 51, 52. Appropriate adjustment of these valves enables all, part, or none, of the flowing composition to pass through an electrical characteristics meter 53, so that continuous or intermittent monitoring of the selected characteristic may be effected. Associated circuitry 54 enables signals from meter 53 to be transmitted to, and displayed on, a visual display unit (VDU) 55.

If the monitored value of the electrical characteristic indicates an unsatisfactory emulsion, valves 56, 57 may be adjusted to divert the composition into discharge conduit 58 from which the composition may be (a) fed to a treatment station (not shown) for further processing and possibly eventual recycle, or (b) discharged for use in a less critical application. If the emulsion proves to be electrically acceptable, valves 56, 57 may be adjusted so that the composition is fed to blender 59 where adjuvants, such as microballoons, are introduced into the composition, which is then fed to processing station 60, where, for example, the emulsion is incorporated into cartridges.

The mobile carrier assembly of FIG. 5 comprises a truck 70, on the load platform 71 of which is mounted, in a supporting framework (not shown), storage tanks 72, 73 respectively for the oxidiser and continuous phase components of the emulsion. The oxidiser component is transferred through valve 74, conduit 75, pump 76 and flow meter 77 to an emulsification chamber 78, the continuous phase component likewise being transferred to chamber 78 through valve 79, conduit 80, pump 81 and flow meter 82. The resultant emulsion explosives composition emerging from chamber 78 through control valve 83 is monitored by electrical characteristics meter 84 and may be diverted through valve 85 into conduit 86 for further treatment or discharge. Alternatively, the composition may flow through valve 87 to be incorporated with an adjuvant delivered from hopper 88 through valve 89, and subsequently discharged through valve 90 into conduit 91 from which it may be delivered directly into an on-site borehole.

The invention is further illustrated by reference to the following Examples in which all parts and percentages are expressed on a weight basis unless otherwise stated.

EXAMPLES 1 TO 5

Various emulsion explosive compositions were prepared as follows:

A mixture of ammonium nitrate (78.7 parts), and water (16.0 parts) was heated with stirring to a temperature of 85° C. to give an aqueous solution. The hot aqueous solution was added, with rapid stirring, to a solution of a conventional emulsifier (1.5 parts), in refined mineral oil or wax, (3.8 parts), the emulsifier and oil phase being selected in accordance with the accompanying Table. Stirring was continued until a uniform emulsion was obtained.

The electrical conductivity of a sample of each emulsion was measured, as hereinbefore described, at a temperature of 25° C., in a closed flat cell comprising a pair of 304 stainless steel plate electrodes each of area 10 $cm^2$, and spaced apart a distance of 3 mm by peripheral spacers of polymethylmethacrylate.

Glass microballoons (2.5 parts; grade C15/250 supplied by 3M) were added to the remainder of each emulsion and thoroughly mixed therein.

Each composition was allowed to cool and samples thereof were then packaged into conventional cylindrical paper cartridges of 25 mm diameter. These cartridges were respectively stored at temperatures of 10° C. and 40° C., and were periodically tested for cap sensitivity using a detonator comprising a base charge of lead azide (0.15 g) and PETN (0.8 g).

The maximum period (weeks) for which a cartridge of each composition remained sensitive to the detonator is recorded as the storage life thereof in the accompanying Table.

TABLE

| Example | Emulsifer* | Oil Phase | Electrical Conductivity at 25° C. (picomhos/m) | Storage life at 10° C. (weeks) | Storage life at 40° C. (weeks) |
|---|---|---|---|---|---|
| 1 | HDHMO | Paraffin Oil | 14,500 | <3 | — |
| 2 | SMO | Paraffin Oil | 7,000 | 10 | <3 |
| 3 | SMO | Slackwax 431 | 2,900 | 24 | — |
| 4 | PIBSA/E | Paraffin Oil | 23 | >100 | >100 |
| 5 | PIBSA/E | Slackwax 431 | 14 | >100 | >100 |

*HDHMO = 2-heptadecenyl-4,4-bis(hydroxymethyl)oxazoline
SMO = sorbitan mono-oleate
PIBSA/E = Condensate of polyisobutenyl succinic anhydride (MW 1200) and ethanolamine The correlation between storage life and measured electrical conductivity is evident from the tabulated data.

EXAMPLES 6 TO 8

Emulsions were made according to the formulation of Example 2, and mixed for varying periods to yield explosive compositions each having a different average droplet size, as determined by optical microscopy.

A capacitance cell of the same construction as described with reference to Examples 1 to 5, and having a nominal empty cell capacitance of 30 picofarads (determined by calculation), was filled in turn with a sample of each emulsion, and the capacitance thereof measured at an electrical frequency of 800 Hz using a Metertech MT 301 digital capacitance meter.

Results are recorded in the accompanying Table.

TABLE

| Example | Electrical Capacitance (picofarads) | Droplet Size (microns) |
|---|---|---|
| 6 | 18,000 | 1.5 |
| 7 | 22,500 | 2.0 |
| 8 | 32,100 | 3.0 |

The correlation between measured electrical capacitance and emulsion droplet size is evident from the tabulated data. Capacitance measurement may therefore be employed instead of optical microscopic examination as a quality control procedure. A decrease in emulsion droplet size is generally observed to yield an explosives product exhibiting increased sensitivity and improved storage stability.

EXAMPLES 9 TO 12

The aqueous phase volume of emulsion explosive compositions according to the formulation of Example 6 (droplet size 1.5 microns) was varied in a range of from 92 to 96% by varying the oil:water ratio. Electrical capacitance measurements, effected as described in relation to Examples 6 to 8, are recorded in the accompanying Table.

TABLE

| Example | Electrical Capacitance (picofarads) | Aqueous Phase Volume (%) |
|---|---|---|
| 9 | 18,000 | 92 |
| 10 | 20,400 | 94 |
| 11 | 21,500 | 95 |
| 12 | 23,000 | 96 |

It is evident from the above data that, knowing the average droplet size of the emulsion composition, electrical measurements may be used to determine the phase volume of the emulsion, i.e. to check that the ingredient ratios are at the desired level.

We claim:

1. A method of improving the quality of an emulsion explosive composition comprising a discontinuous phase containing an oxygen-supplying component and an organic medium forming a continuous phase characterised by selecting an electrical characteristic of the explosive composition, establishing a predetermined range of acceptable values for that characteristics, measuring the selected characteristic of the explosive composition, and, in response to a measured electrical characteristic outside the predetermined range, diverting the unacceptable composition, or treating the composition to restore the selected electrical characteristic thereof to within the predetermined acceptable range.

2. A method according to claim 1 wherein the selected electrical characteristic is electrical conductivity.

3. A method according to claim 1 wherein the selected electrical characteristic is electrical capacitance.

4. A method according to any one of the preceding claims wherein the measurement is effected at an electrical frequency not exceeding 10 MHz.

5. A method according to any one of claims 1, 2 and 4 wherein the measurement is effected at an electrical frequency not exceeding 2.0 Hz.

6. A method according to claim 5 wherein the measurement is effected at zero electrical frequency.

7. A method according to any one of the preceeding claims wherein the measurement is effected at a temperature not exceeding 150° C.

8. A method according to one of the preceding claims wherein the measurement is effected in a static location, or on, or in association with, a mobile carrier.

9. A method of producing an emulsion explosive composition comprising monitoring the quality of the composition by a method according to any one of the preceding claims.

* * * * *